US005335480A

United States Patent [19]

Zaeske et al.

[11] Patent Number: 5,335,480

[45] Date of Patent: Aug. 9, 1994

[54] METHODS OF AND APPARATUS FOR PACKAGING A PRODUCT

[75] Inventors: Donald A. Zaeske, Cudahy; Raymond E. Ceplina, South Milwaukee; Rick V. Weber, Cudahy; Gregory A. Tweed, South Milwaukee, all of Wis.

[73] Assignee: Emmber Foods, Inc., Milwaukee, Wis.

[21] Appl. No.: 993,626

[22] Filed: Dec. 21, 1992

[51] Int. Cl.[5] ..... B65B 25/22; B65B 29/08

[52] U.S. Cl. ..... 53/431; 53/111 RC; 53/239; 53/426; 53/469; 452/35

[58] Field of Search ..... 53/431, 440, 469, 477, 53/426, 111 RC, 271, 239; 452/35, 30

[56] References Cited

U.S. PATENT DOCUMENTS

| | | | |
|---|---|---|---|
| 2,825,190 | 3/1958 | Heald | 53/431 X |
| 3,574,642 | 4/1971 | Weinke | 99/174 |
| 3,625,348 | 12/1971 | Titchenal et al. | 206/46 F |
| 3,653,927 | 4/1972 | Howell et al. | 99/174 |
| 3,759,722 | 9/1973 | Simon | 99/174 |
| 3,777,447 | 12/1973 | Herbine et al. | 53/239 X |
| 3,813,847 | 6/1974 | Kuhnle | 53/239 X |
| 3,864,503 | 2/1975 | Steenolsen | 426/232 |
| 3,885,053 | 5/1975 | Townsend | 452/35 X |
| 3,956,867 | 5/1976 | Utz et al. | 53/22 |
| 3,961,090 | 6/1976 | Weiner et al. | 426/281 |
| 3,982,376 | 9/1976 | Ikeda | 53/239 X |
| 3,983,258 | 9/1976 | Weaver | 426/307 |
| 4,099,914 | 7/1978 | Gustafsson et al. | 53/426 |
| 4,218,486 | 8/1980 | Beiler et al. | 426/412 |
| 4,285,980 | 8/1981 | Lewis | 426/249 |
| 4,356,206 | 10/1982 | Boldt | 426/519 |
| 4,411,919 | 10/1983 | Thompson | 426/412 |
| 4,545,177 | 10/1985 | Day | 53/434 |
| 4,671,047 | 6/1987 | Mugnai | 53/550 |
| 4,704,843 | 11/1987 | Owen et al. | 53/450 |
| 4,709,532 | 12/1987 | Taylor | 53/451 |
| 4,820,536 | 4/1989 | Lippincott et al. | 426/412 |
| 4,905,587 | 3/1990 | Smithers | 452/35 X |

FOREIGN PATENT DOCUMENTS 2135648A 9/1984 United Kingdom .

OTHER PUBLICATIONS

F. M. Terlizzi, R. R. Perdue, L. L. Young, "Processing and Distributing Cooked Meats in Flexible Films," Food Technology, p. 67 (Mar. 1984).

Product Brochure: "Cryovac Model 8150 Rotary Vertical Chamber Machine," published by Cryovac, a Division of W. R. Grace & Co.

Product Brochure: "Cryovac CN-Series Cook-In Materials," published by Crovac, a Division of W. R. Grace & Co.

*Primary Examiner*—James F. Coan

*Attorney, Agent, or Firm*—Marshall, O'Toole, Gerstein, Murray & Borun

[57] ABSTRACT

A device for loading a product into a container wherein the device includes a delivery apparatus movable during a travel cycle toward and away from a travel limit and wherein the product is delivered through the delivery apparatus into the container during a certain portion of the travel cycle includes means operable during another portion of the travel cycle prior to the certain portion for applying a coating to an inner wall of a container.

22 Claims, 9 Drawing Sheets

FIGURE 8
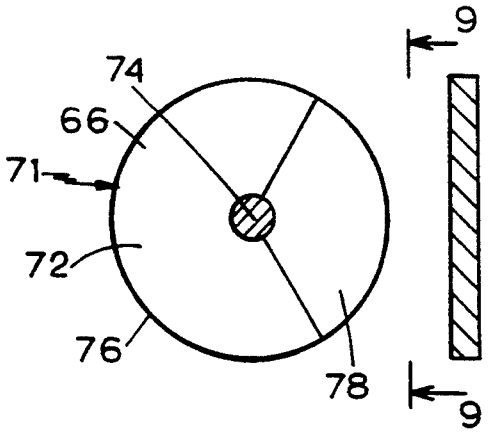
FIGURE 9
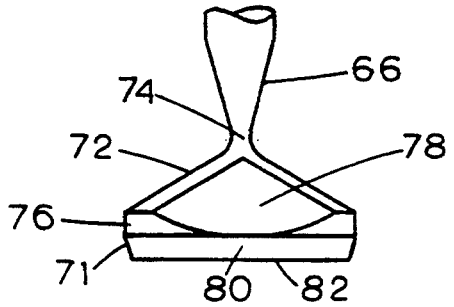
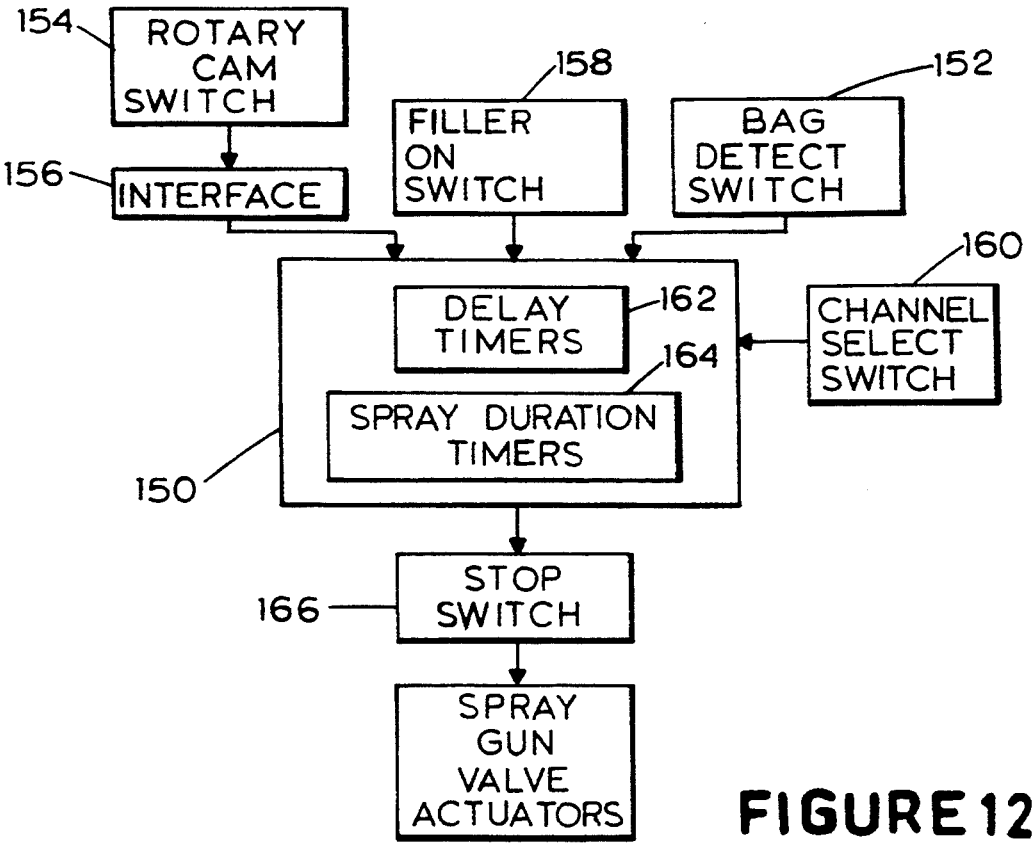
FIGURE 12

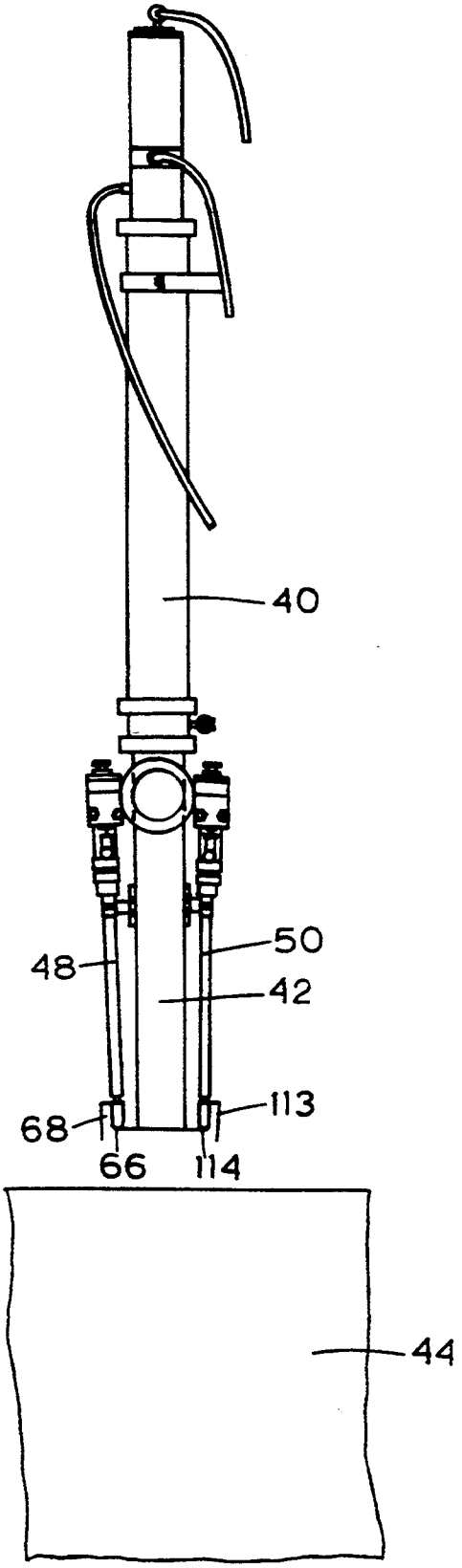
FIGURE 10
FIGURE 11
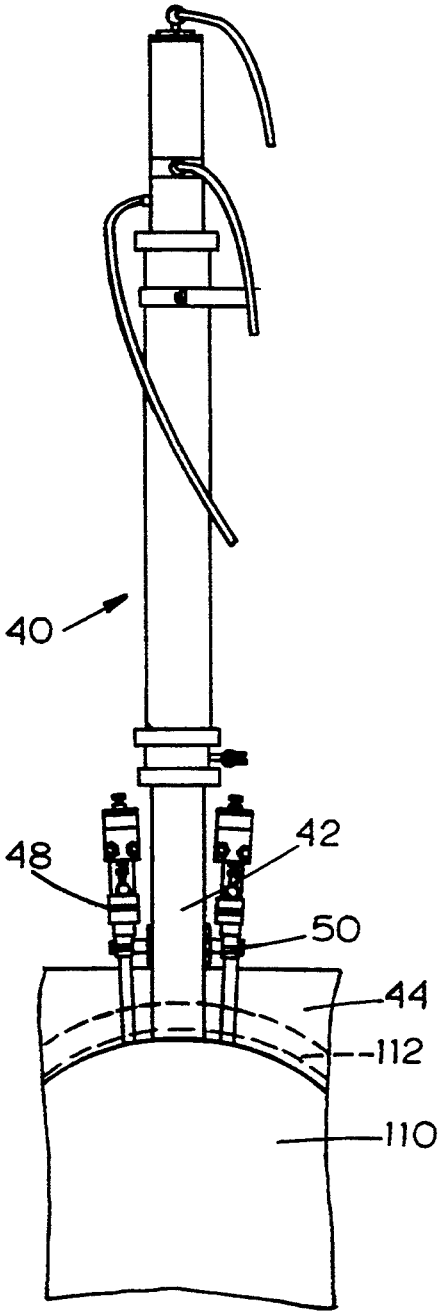

METHODS OF AND APPARATUS FOR PACKAGING A PRODUCT

TECHNICAL FIELD

The present invention relates generally to packaging methods and systems, and more particularly to a method of and system for packaging a food product, such as a restructured meat product.

BACKGROUND ART

There is often a need to package a product in a container, such as a bag of heat shrinkable film. For example, in the case of restructured meat products sold to delicatessens and other food outlets, uncooked restructured meat is deposited in and cooked in a bag fabricated of a cling film. Cooking improves shelf life by killing microbes that would otherwise result in spoilage. However, cooking temperatures also tend to release moisture from the meat. This "purge" may cause the meat to become dried out and thus less palatable to the consumer. Also, the loss of moisture reduces the weight of the meat, which is economically disadvantageous for a product that is priced on a per-pound basis.

A conventional way of preventing purge is to cook the meat in a cling film made of a material that binds to proteins on the surface of the meat and forms a moisture barrier that reduces moisture loss.

The use of cling films is an effective method of controlling purge; however, it creates difficulties when meat products, such as beef, are to have a "rub" applied thereto. This rub, which is a combination of dry seasonings and caramel coloring that is applied to the surface of the beef to improve its flavor and to provide an oven roasted appearance, prevents clinging of the film apparently due to the interference of the rub with the adhesion of the film to proteins on the meat surface. As a result, purge is undesirably increased.

A hydrolyzed meat protein product marketed under the commercial designation AMP 600 by American Meat Protein Corporation (Ames, Iowa), when added to a restructured meat product, limits purge even when cling films are not used. It is desirable, however, to avoid the use of additives whenever possible due to the cost and the possible negative labeling impact of same.

In an attempt to overcome the foregoing problem, a two step process was developed whereby the cling film was removed from the unrubbed meat after cooking, rub was applied to the meat and then the meat was repackaged with new film. Beyond the obvious inefficiencies of the foregoing process, the meat was again exposed to microbes, in turn shortening shelf life.

A still further process was developed that avoided the need to open the film in which the meat was cooked. The film was heated and a rub solution was applied to a portion thereof. The film was then stretched to form a bag such that the rub was disposed on the inside of the bag. During this stretching step, the rub solution was dried, leaving a relatively uniform coating thereof. Thereafter, the meat product, which was previously treated with a commercial ingredient for preventing purge, was placed in the bag. A second bag was then placed around the meat and the two bags were heat shrunk together. The meat was then cooked in the bags, cooled and shipped.

The foregoing process was abandoned due to difficulties encountered in automating the system.

Other attempts at applying a rub to a meat product before cooking involved sprinkling of dry powder into a bag before the meat was loaded therein, painting the bag with an aqueous rub solution after the bag was formed or adding a measured amount of aqueous rub solution to the bag and then spreading the solution with some type of mechanism.

These prior methods of applying rub before cooking yielded inconsistent rub coverage on the finished product, and hence, have not been completely satisfactory.

Thus, there remains a need in the art for a process of packaging materials such as restructured meat products whereby a consistently uniform rub coating may be applied to such meat products over the entire surface of the product in an efficient manner with the avoidance of post- packing contamination of the product or heat seal in the package consistent with federal regulatory guidelines and industry safety standards.

SUMMARY OF THE INVENTION

In accordance with the present invention, a coating is applied to an inner wall of a container in a simple and effective fashion.

More particularly, according to one aspect of the present invention, an improvement in a device for loading a product into a container wherein the device includes a delivery apparatus movable during a travel cycle toward and away from a travel limit and wherein the product is delivered through the delivery apparatus into the container during a certain portion of the travel cycle comprises means operable during another portion of the travel cycle prior to the certain portion for applying a coating to an inner wall of the container.

Preferably, the applying means comprises a sprayer and means for actuating the sprayer while the delivery apparatus is moving toward the travel limit.

Also in accordance with the preferred embodiment, the product comprises restructured meat, the delivery apparatus comprises a stuffing horn, the coating comprises a rub and the container comprises a heat sealable bag sealed by a heated seal bar after loading of the restructured meat into the bag.

In accordance with a further aspect of the present invention, an apparatus for packaging a restructured meat product in a heat-sealable, cook-in bag includes a stuffing horn movable toward and away from a travel limit, first and second sprayers disposed on opposite sides of a stuffing horn and movable therewith, means for positioning the bag below the stuffing horn and the sprayers and means for moving the stuffing horn and the sprayers into the bag toward the travel limit. Means are provided for operating the sprayers as the stuffing horn and the sprayers are moving toward the travel limit such that a rub is applied to an inner wall of the bag. Reversing means reverse the direction of movement of the stuffing horn and the sprayers once the travel limit is reached. Further means are provided for operating the stuffing horn such that restructured meat product is deposited into the bag after the travel limit is reached. Means are also supplied for sealing the bag by applying heat thereto.

In accordance with yet another aspect of the present invention, a method of loading a product into a container includes the steps of positioning the container in alignment with a delivery apparatus and a spray apparatus wherein the delivery apparatus and the spray apparatus are movable toward and away from a travel limit, moving the delivery apparatus and the spray apparatus into the container toward the travel limit and operating the spray apparatus to deposit a coating on an inner wall of the container as the spray apparatus is moved toward the travel limit. The direction of movement of the delivery apparatus is reversed at the travel limit and the delivery apparatus is operated after operation of the spray apparatus to deliver product into the container.

In accordance with yet another aspect of the present invention, a method of packaging a restructured meat product includes the steps of providing a heat-sealable bag, positioning the bag in alignment with a stuffing horn and a spray apparatus wherein the stuffing horn and the spray apparatus are movable toward and away from a travel limit and moving the stuffing horn and the spray apparatus together into the bag toward the travel limit. The spray apparatus is operated to deposit a rub on an inner wall of the bag as the spray apparatus is moving toward the travel limit. The stuffing horn and the spray apparatus are withdrawn from the bag after the travel limit is reached and the stuffing horn is operated after operation of the spray apparatus to deliver restructured meat product into the bag. The bag is heat sealed after the product is delivered therein.

The method and apparatus of the present invention permit packaging and cooking of a product in a simple and economical fashion.

Other objects and advantages of the invention will be apparent to those skilled in the art from a review of the following detailed disclosure, taken in conjunction with the drawings and the appended claims.

BRIEF DESCRIPTION OF THE DRAWINGS

FIG. 8 comprises a sectional view taken generally along the lines 8—8 of 7;

FIG. 9 comprises a fragmentary elevational view taken generally along the lines 9—9 of FIG. 8;

FIGS. 10 and 11 comprise elevational views illustrating the operation of the spraying apparatus of FIGS. 2–4;

FIG. 12 comprises a block diagram of a programmable controller together with associated components for controlling the spraying apparatus of FIGS. 2–4.

DESCRIPTION OF THE PREFERRED EMBODIMENT

Figure 1:
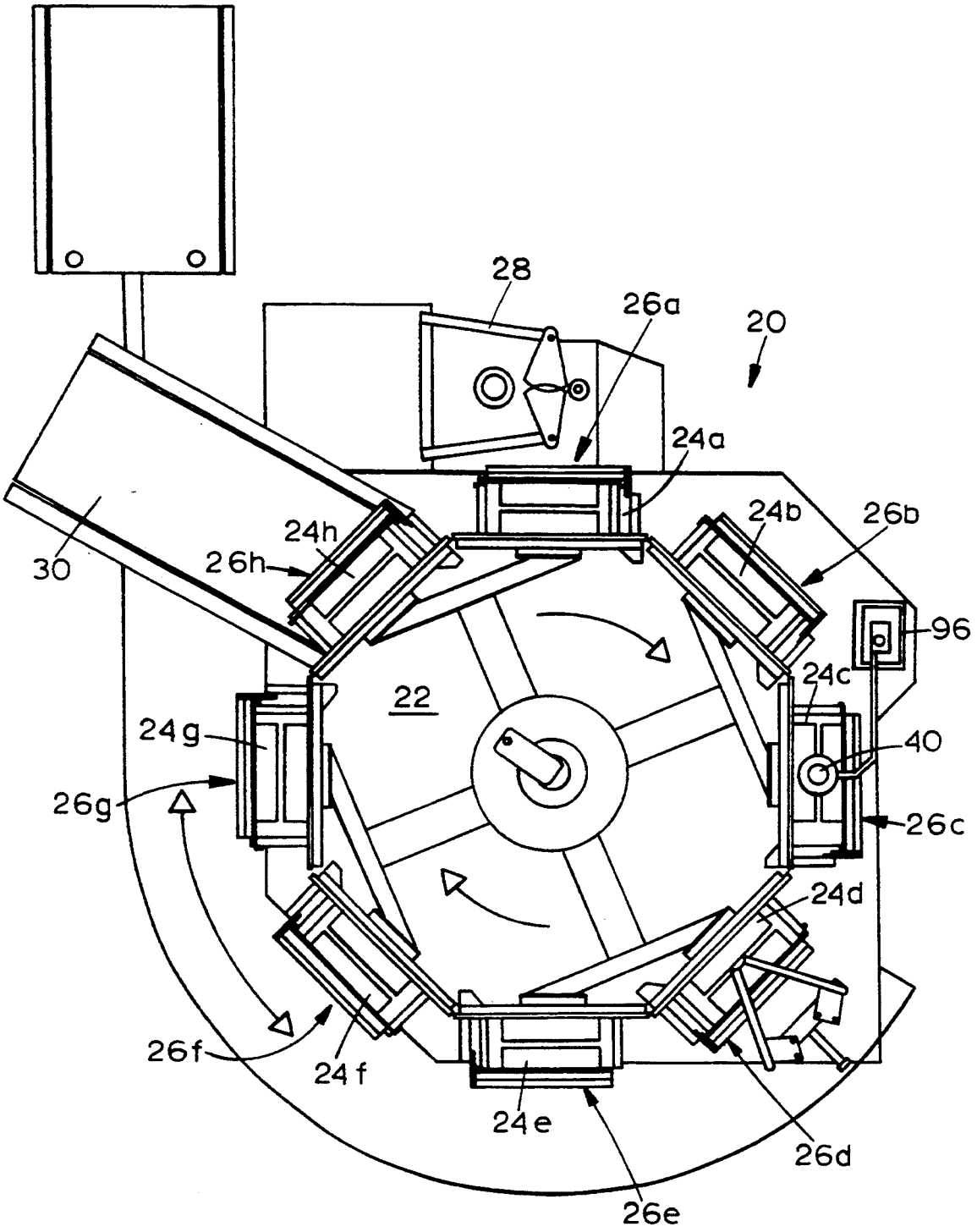
FIG. 1 comprises a diagrammatic plan view of a device for loading a product into a container incorporating the present invention.

Referring now to FIG. 1, there is illustrated in diagrammatic form a device 20 for loading a product into a container. In the preferred embodiment, the device 20 comprises a model 8150 rotary vertical chamber machine manufactured by the Cryovac Division of W. R. Grace and Company located in Duncan, S.C. 29934. The device 20 includes a turntable 22 that positions each of a series of packaging stations **24*a*–24*h* at each of a plurality of process positions or locations 26*a*–26*h* for a predetermined period of time. When the turntable 22 is in the position shown in FIG. 1, a cock-in bag (described in greater detail hereinafter) is deposited on the station 24*a* by a bag handler 28. Thereafter, as the bag is transported with the station 24*a* in a clockwise direction (as seen in FIG. 1), the bag is opened at the station 26*b*, sprayed with a material on the inner wall thereof and loaded with product at the station 26*c* and vacuum sealed and deposited on a take-away conveyor 30 at the positions 26*d*–26*h***.

As one example, the material sprayed on the inner wall of the bag may comprise approximately 0.15–0.20 pounds of an aqueous rub slurry per 10 pounds of packed meat product. In this case the slurry may be preferably formed of about 50 to about 70 wt. % (highly preferably about 60 wt. %) dry rub and about 50 to about 30 wt. % (highly preferably 40 wt. %) water wherein the dry rub illustratively comprises onion powder, salt, hydrolyzed vegetable protein, caramel color, dextrose, paprika, sugar, garlic powder, soybean oil and natural beef flavor (beef stock, autolyzed yeast, beef extract, vegetable oil, lecithin and flavorings). The product packaged in the bag preferably comprises a restructured meat product, such as roast beef, and more particularly a chunked and formed product, although sectioned and formed or whole muscle meats or any other product could be packaged. Useful meats include but are not limited to other types of beef, pork and poultry.

The ratio of dry rub to water in the slurry is selected such that efficient continuous spraying of the slurry can be effected with the apparatus of the invention. Although a slurry containing a high proportion of rub to water (e.g. 2:1) may be used, lower proportions of rub are preferred since spray nozzles tend to clog at such high rub levels. Clogging can also occur at lower slurry temperatures, and hence the slurry temperature at the time of spraying should be held at a level which avoids this problem.

Further, those skilled in the art will recognize that the identity and proportions of seasonings, color, water, additives, etc. will vary with the product to be packed.

For a 10 pound meat product, including liquids, a heat shrinkable bag approximately 11 inches by 18 inches in size is typically useful. Other sizes of meat product and bags may be used, as desired.

For the processing of restructured meat products, the meat product is typically blended with a solution of NaCl, water, and a phosphate solution to extract optimum amounts of protein. A binder comprising meat trimmings is also emulsified with a NaCl, water and phosphate solution. The binder should not be prepared more than about 3 hours before being blended with the meat chunks. Temperature control is important in this portion of the processing. Temperature control optimizes protein extraction and holds down bacteria counts while optimizing the actions of the various ingredients. The temperature is desirably controlled to be as low as possible, i.e. a maximum of about 35° F. with a minimum dictated only by the freezing point of the solution. The minimum temperature is generally about 28° F., depending on the salt content of the solution. The respective temperatures of the binder and lean meat chunks are desirably within about 5° F. of each other. Once the binder is prepared, it is added to the lean meat chunk/water/salt/phosphate mixture and blended under vacuum for optimum dispersion and protein extraction.

The ingredients and the overall processing extract protein from the meat and increases the yield, i.e. the weight of the final product, while improving flavor and tenderness. The salt and other components of the solution improve shelf life.

Premium meat products made according to the invention will typically contain up to about 20 wt. % of the phosphate solution, with somewhat higher levels of solution (i.e. up to about 35 wt. %) used for lower priced products. Lower priced products may include a hydrolyzed protein product such as AMP 600, if desired.

Figure 2:
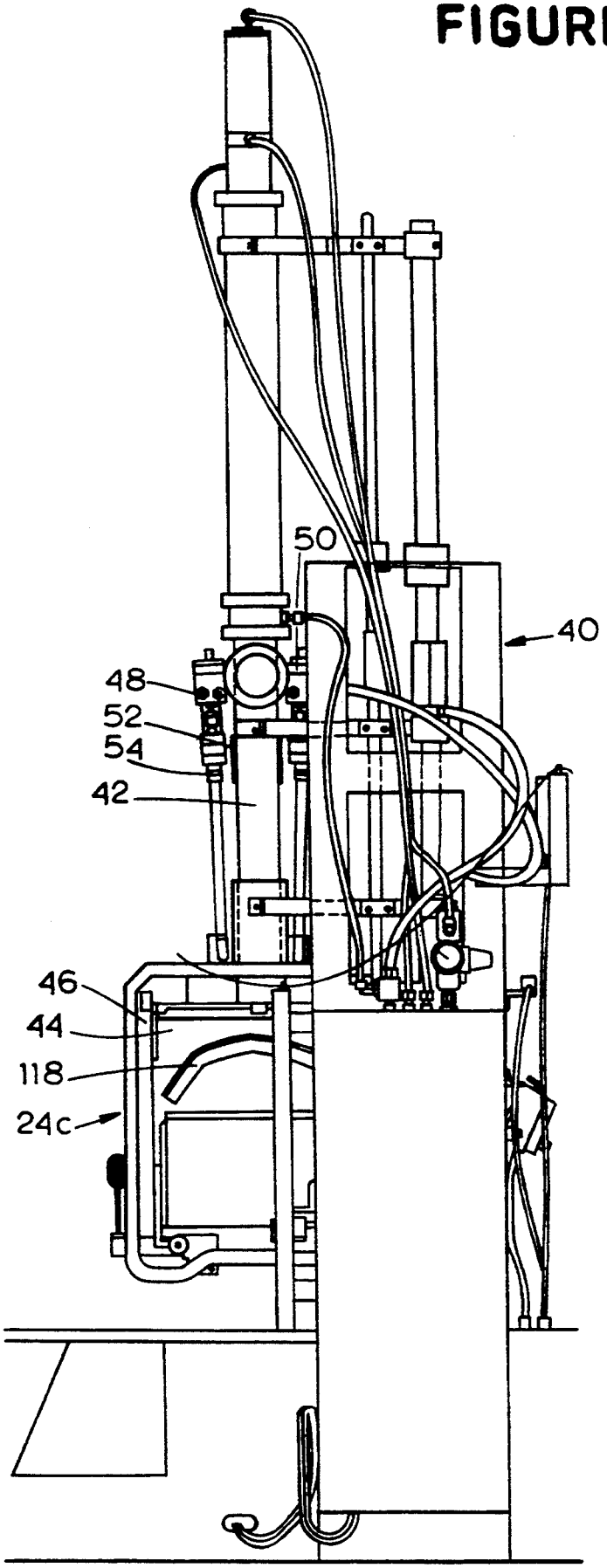
FIG. 2–4 are front, left-hand and right-hand side elevations, respectively, of a portion of the apparatus of FIG. 1 illustrating the present invention in greater detail.
Figure 3:
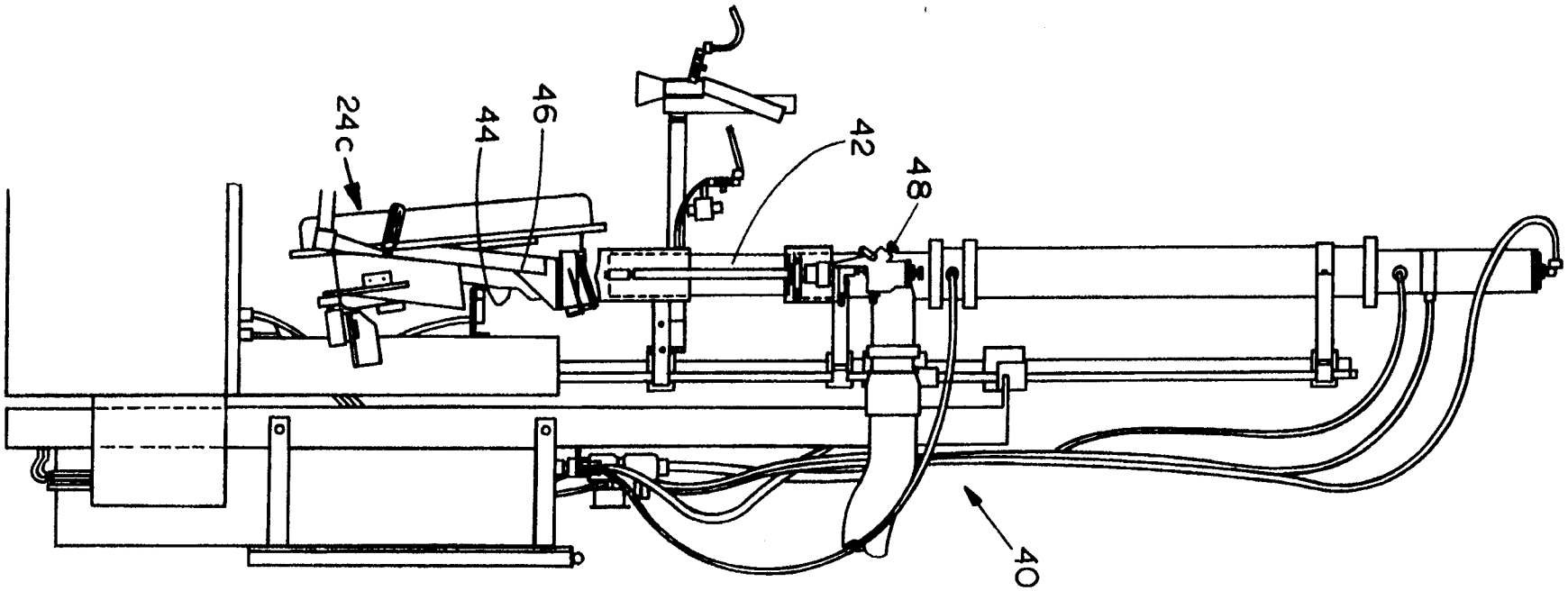
Figure 4:
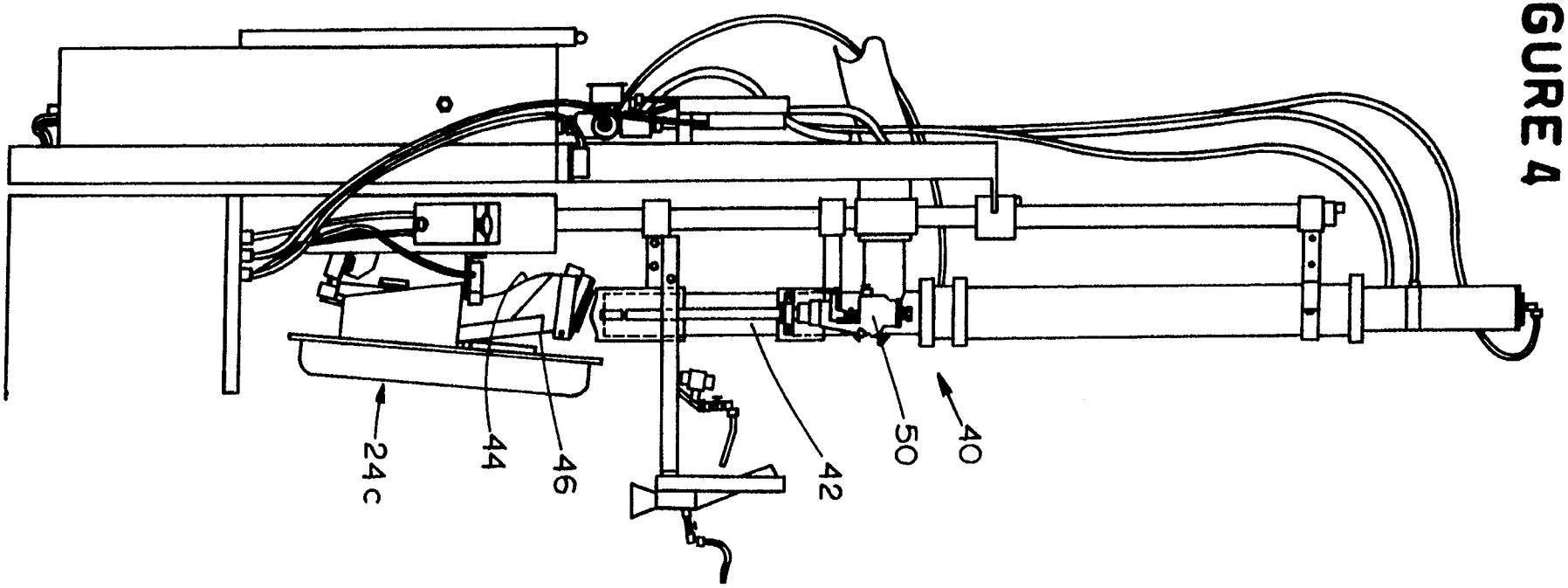

FIGS. 2–4 illustrate the apparatus 40 disposed at the position 26c of FIG. 1 for spraying rub slurry on the inside of a bag and for depositing a restructured meat product therein. The apparatus 40 includes a product delivery apparatus or stuffing horn 42 that delivers restructured meat product into a cook-in bag 44 positioned in alignment with the stuffing horn 42 by a bag opening and supporting apparatus 46 of the packaging station 24c.

In the preferred embodiment, the bag is made of a heat shrinkable bag material sold by the Cryovac Division of W. R. Grace and Company under the trade designation CN530. The bag may or may not be printed and may or may not have a protein binding layer on the inner surface thereof. Non-adherent bags are preferred, since the presence of a rub interferes with film/meat surface interaction.

First and second sprayers 48, 50 are secured by brackets 52, 54 to the stuffing horn 42 on opposite sides thereof. As noted in greater detail hereinafter, the stuffing horn 42 and the sprayers 48, 50 are movable during a travel cycle along a vertical line toward and away from a lower travel limit.

Figure 6:
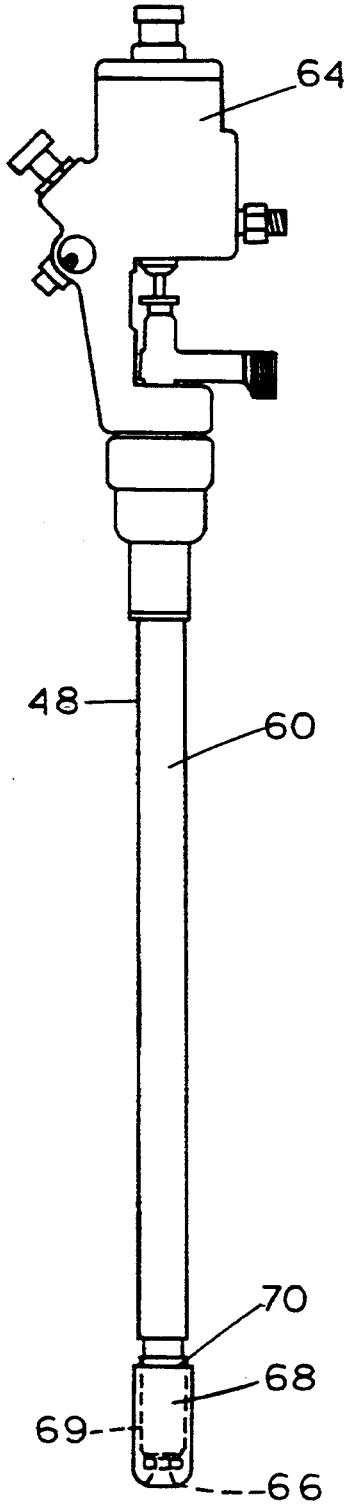
FIGS. 5 and 6 are front and left-hand side elevations, respectively, of the sprayers shown in FIGS. 2–4.
Figure 5:
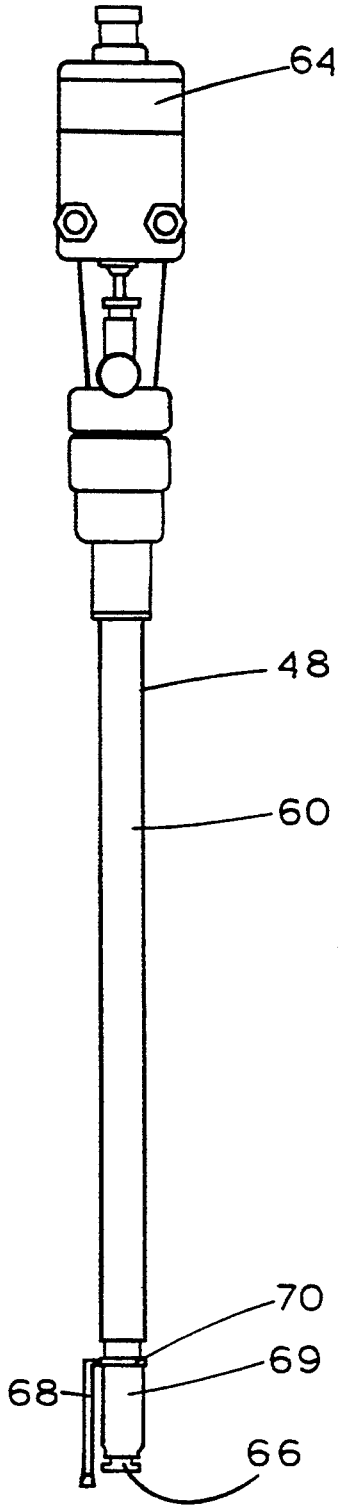
Figure 7:
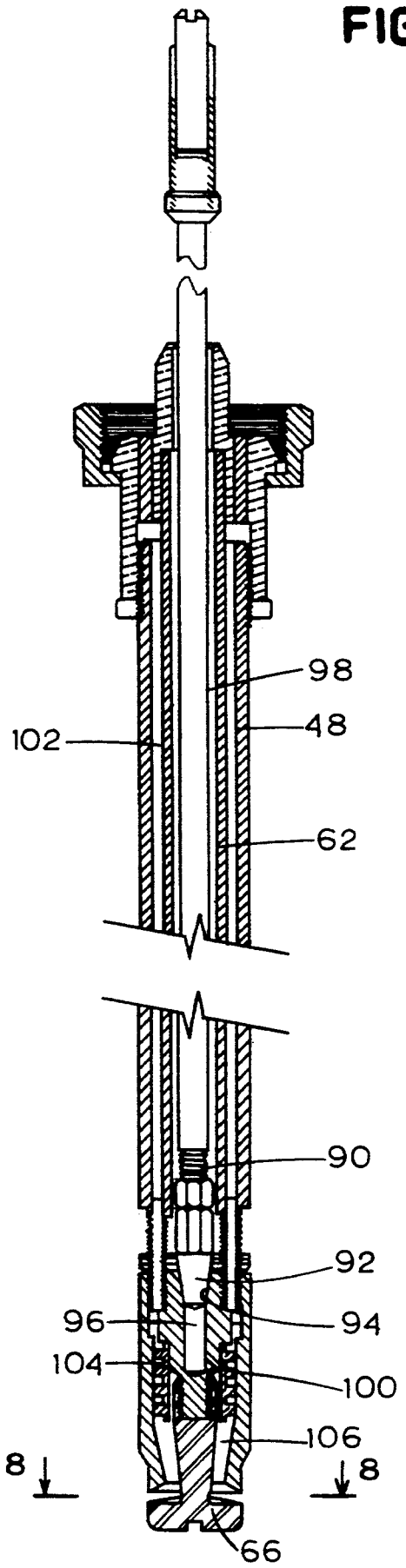
FIG. 7 comprises a partial sectional view of a portion of one of the sprayers of FIGS. 2–4 with the shield removed therefrom.

FIGS. 5–7 illustrate the sprayer 48 in greater detail, it being understood that the sprayer 50 is identical thereto. The sprayer is a modified version of the Model 610 spray gun manufactured and sold by Binks Manufacturing, Inc. of Schiller Park, Ill.. The modifications to the Model 610 spray gun are: (1) a body portion 60 and interior components 62 have been extended to an approximate length of 18 inches to provide an adequate distance between a valve head 64 and a spray tip 66; (2) the spray tip 66 has been modified by the forming of a sloped portion by grinding or another process, as described in greater detail hereinafter in connection with FIGS. 8 and 9; (3) the sprayer has been fabricated of stainless steel instead of brass; and (4) a shield 68 has been secured to the sprayer between an endbody 69 and a lock nut 70 to control the spray of rub on the inner wall of the bag, as noted in greater detail hereinafter. (The shield 68 and a corresponding shield 113 on the sprayer 50 are not shown in FIGS. 3 and 4.)

FIGS. 8 and 9 illustrate the spray tip 66 in greater detail. The spray tip 66 includes a base 71 having an upper base surface 72 that slopes or tapers downwardly from a center post portion 74 to an outer circumferential wall 76. A sloped portion 78 extends from the upper base surface 72 to a lower tapered surface 80. The sloped portion 78 preferably is planar and forms an angle of approximately 60° with respect to a bottom surface 82. In the preferred embodiment, the lines defining the intersection of the sloped portion 78 with the upper base surface 72 form an angle of 30° therebetween.

Referring again to FIG. 7, the rub slurry is delivered into an inner chamber 90 within the sprayer 48. A valve needle 92 is normally biased into engagement with the valve seat 94, thereby preventing the flow of slurry 90 under pressure into a chamber 96. However, when rub is to be applied to the inner wall of the bag 44, a valve actuator in the sprayer head 64 is electrically operated by a programmable controller (described in greater detail hereinafter) located in a control housing 96 (FIG. 1) to retract a connecting rod 98 and the valve needle 92 out of engagement with the valve seat 94. The slurry int he chamber 90 is thus permitted to travel into the chamber 96 and through the port 100. Simultaneously, compressed air, preferably at an approximate pressure of 38–40 p.s.i.g., is delivered through a circumferential channel 102 and spiral ports 104 into a spray tip channel 106. The ports 104 cause the compressed air to become turbulent and atomize the slurry delivered to the channel 106, thereby causing forceful ejection of the atomized slurry out of the chamber 106.

FIGS. 10 and 11 illustrate the movement of the apparatus 40 into the bag 44 and the operation of the sprayers 48, 50 and the stuffing horn 42 in greater detail. It should be noted that various items and details of the apparatus 40 are not shown in these figures for the sake of clarity. At the beginning of a travel cycle, the stuffing horn 42 and the sprayers 48, 50 are disposed at an upper travel limit, seen in FIG. 10. During a first portion of the travel cycle, the stuffing horn 42 and the sprayers 48 and 50 are moved together downwardly into the bag 44 toward the lower travel limit, preferably at an approximate speed of 9 inches per second. Once a particular point in the first portion of the travel cycle is reached, the sprayers 48 and 50 are actuated as they are moving into the bag 44 such that a coating 110 of rub is deposited on the inner wall of the bag 44. In the preferred embodiment, the sprayers are actuated for a period of time substantially equal to 1.5 seconds, although a different spray duration may be selected. This spray duration is dependent upon the speed of travel of the sprayers 48 and 50, the nature of the rub, the flow rate of the rub and the amount of rub to be applied. As seen in FIG. 11, the resulting coating pattern has an inverted U-shape that substantially prevents the application of rub to a portion 112 (shown in dotted lines) of the bag 44. This inverted U-shaped coating pattern is formed by the shield 68, a shield 113 on the sprayer 50, the spray tip 66 of the sprayer 48 and a spray tip 114 of the sprayer 50 (shown in FIG. 10). More particularly, the upper base surfaces 72 and the sloped portions 78 of the spray tips 66, 114, together with the shields 68, 113 deflect the rub slurry downwardly at the left and right portions of the bag 44 at the beginning of a spray operation so that the inverted U-shape is formed. In the preferred embodiment, the shield has a width of approximately 1 inch and extends approximately ⅜ inch below the lower surface 80 of the spray tip 66.

As noted above, the rub slurry is preferably, although not necessarily, applied as the stuffing horn 42 and the sprayers 48 and 50 are moving toward the lower travel limit. At or immediately before the lower travel limit is reached, the sprayers 48, 50 are preferably deactuated so that the application of rub slurry is terminated. Once the travel limit is reached, the direction of movement of the stuffing horn 42 and the sprayers 48 and 50 is reversed so that a second portion of the travel cycle is initiated. During the second portion of the travel cycle, a restructured meat product, such as roast beef, ham, corned beef or any other product (food or otherwise) is deposited by the stuffing horn 42 into the bag 44. The stuffing horn 42 and the sprayers 48 and 50 continue to move upwardly during the second portion of the travel cycle until the upper limit is reached as seen in FIG. 10. At this point, the stuffing horn 42 and the sprayers 48 and 50 are clear of the bag 44 and the turntable 22 is actuated to move the loaded bag to the positions 26*d*–26*h*, where air is withdrawn from the bag 44 in a vacuum chamber (not shown) and where a heated seal bar having a shape substantially like that of a seal bar seat 118 (FIG. 2) of the bag opening and supporting apparatus 46 heats and seals the bag substantially at the portion 112. By confining the spray pattern of the rub to that shown in FIG. 11, no rub is deposited in the portion 112 which would otherwise interfere with sealing of the bag 44.

It should be noted that the vacuum created in the vacuum chamber should not be such as to pull deposited rub slurry into the bag portion 112.

Following the heat sealing step, the bag is trimmed to remove portions above the portion 112 and deposited on the take-away conveyor 30. At this time, the bag may be heat shrunk by heated water or air and thereafter placed in an oven and cooked in a cooking medium at, for example, 165° F. until the meat therein reaches an internal temperature of 150° F. The resulting meat product is then chilled, as to 40° F., for example, before packing and shipping. Temperatures are set by industry standards, and are dictated in part by processing limits of the bag material.

While the rub slurry is preferably applied during the first portion of the travel cycle and product is deposited into the bag in the second portion of the cycle, it should be noted that the rub may instead be applied at least in part as the stuffing horn 42 and the sprayers 48 and 50 are being retracted from the bag but before the product is deposited therein. Also, a machine other than the Cryovac model 8150 machine and a container other than a bag may be used to package the product.

FIG. 12 comprises a block diagram of apparatus for controlling the spraying apparatus shown in the Figures. A programmable controller (PC) 150 is responsive to a bag detect switch 152 and a rotary cam switch 154 provided as part of the Cryovac model 8150 machine. The bag detect switch 152 is disposed adjacent the position 26*b* and detects the presence of a cook-in bag at each of the packaging stations 24*a*–24*h* as such bags reach the position 26*b*. The rotary cam switch 154 is mounted on a drive shaft (not shown) which is in turn coupled to the turntable 22 and which rotates therewith. The rotary cam switch 154 develops a signal which is supplied through an interface circuit 156 to the PC 150 at the end of each complete spraying cycle during which a single bag is sprayed with rub and material is deposited therein.

In addition to the foregoing, the PC 150 is responsive to a filler on switch 158 which must be actuated in order to spray a bag and load product therein and a channel select switch 160 which selects one of a plurality of delay timers 162 and one of a plurality of spray duration timers 164 in the programmable controller 150. The channel select switch 160 permits an operator to select one of a plurality of delay times between detection of a bag on the turntable 22 at the position 24*b* and the initiation of a spraying sequence and further permits the selection of one of a plurality of spray durations during which the sprayers are actuated.

The programmable controller 150 controls the valve actuators in the sprayer head 63 and a corresponding sprayer head of the sprayer 50. A stop switch 166 may be actuated to interrupt a spraying sequence, if desired.

Figure 13:
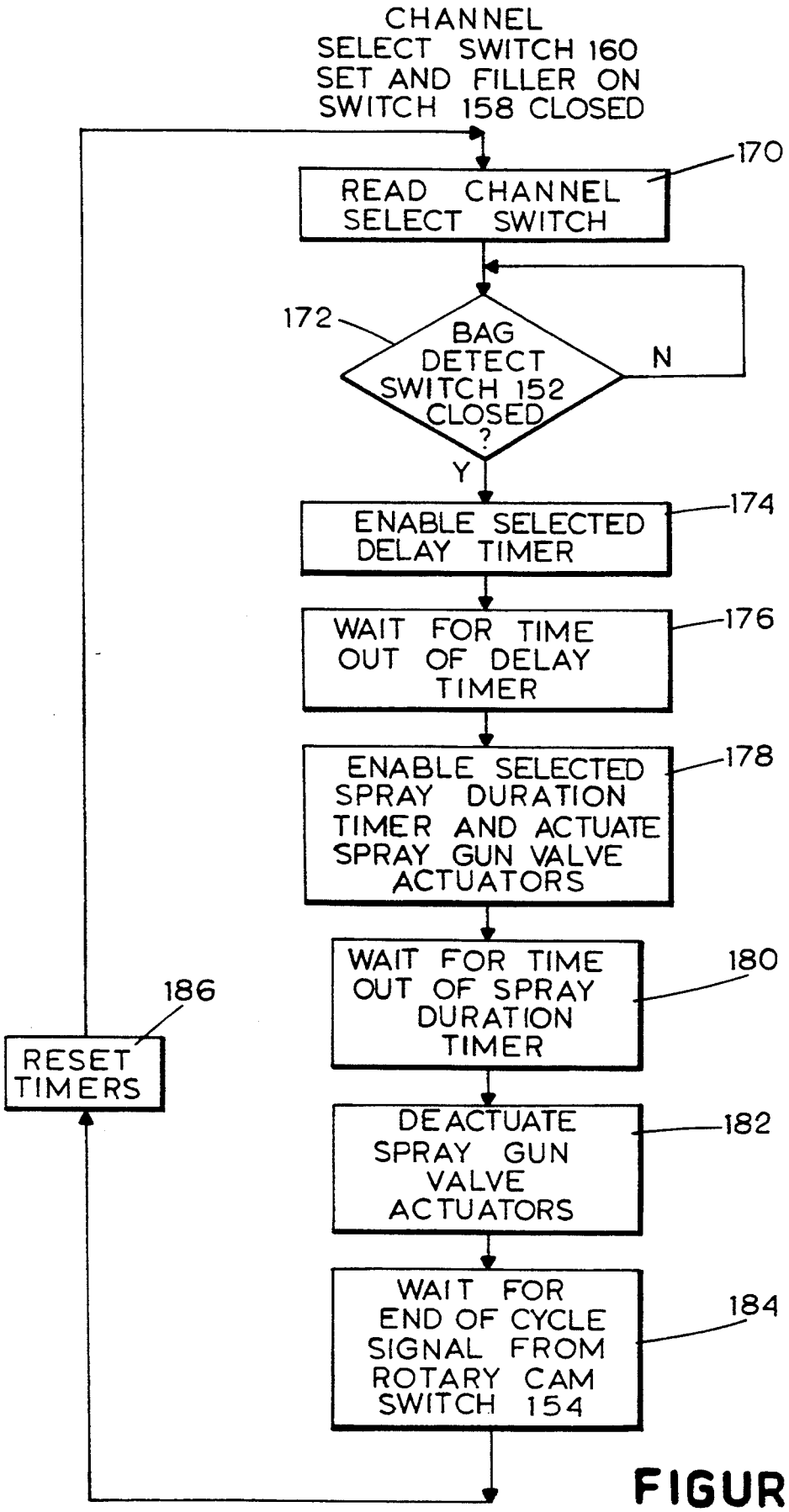
FIG. 13 comprises a flow chart illustrating programming executed by the programmable controller of FIG. 12.

FIG. 13 illustrates the programming executed by the programmable controller 150 to undertake a spraying sequence. In the preferred embodiment, the programmable controller 150 comprises a SLICK 150 programmable controller manufactured by the Allen Bradley Company of Milwaukee, Wis. After the channel select switch 160 has been set to a particular position and after the filler on switch 158 has been closed by an operator, a block 170 reads the position of the channel select switch so as to select one of the delay timers 162 and one of the spray duration timers 164. A block 172 then waits until the bag detect switch 162 is closed by a bag at the packaging station 24*b*. Thereafter, the selected delay timer is enabled by a block 174 to initiate a deadly period during which the bag at the station 24*b* moves to the station 24*c* and the stuffing horn 42 and the sprayers 48, 50 begin to move into the bag. When the delay period expires, as determined by a block 176, a block 178 enables the selected spray duration timer and actuates the spray gun valve actuators so that spraying is initiated. As should be evident from the foregoing description, the delay timer times a period which ensures that the sprayers are at the correct height at the beginning of spraying. A block 180 then monitors the spray duration timer and passes control to a block 182 when the spray duration timer has timed out. At this point, the block 182 deactuates the spray gun valve actuators to terminate the spraying sequence. The spray duration timer 180 times the spray sequence duration so that spraying is terminated at a point which ensures that the required or desired portion of the bag has been sprayed with rub. Following the block 182, control pauses until an end of cycle signal is received from the rotary cam switch 154 via the interface circuit 156. Thereafter, a block 186 resets the timers 162, 164 for the next spraying sequence.

Following the block 186, control returns to the block 170, and a new spraying sequence is thereafter initiated.

The present invention permits a product to be packaged, cooked and shipped in a single bag without exposing the cooked product to microbes until the product is to be eaten. This increases shelf life and minimizes spoilage.

From the foregoing description, those skilled in the art will appreciate that the inventive apparatus and process of the invention provides a product having a uniform oven roasted appearance which is highly consistent from package to package and which is relatively dense as a result of the packing system. The meat product packed according to the invention is never exposed to bacteria-laden surfaces after insertion into the bag and cooking.

Since no stripping of outer cooking bags is required, there is a great savings in labor costs, as well as in material costs resulting from the use of a single bag. Also, since rub can be applied in a more consistent and controlled manner, the cost of this ingredient is minimized.

The invention also provides for very accurate weight control of products as well as faster production rates. The resulting product is more consistent from package to package, and superior bag graphics may be obtained because the process allows the use of preprinted bags.

If desired, the product may be shipped in the same single bag in which it is cooked, or, if desired, an outer bag may be used.

While detailed dimensions and angles have been specified above, it should be understood that such dimensions and angles are exemplary only and should not be construed as limiting the present invention.

Numerous modifications and alternative embodiments of the invention will be apparent to those skilled in the art in view of the foregoing description. Accordingly, this description is to be construed as illustrative only and is for the purpose of teaching those skilled in the art the best mode of carrying out the invention. The details of the structure may be varied substantially without departing from the spirit of the invention, and the exclusive use of all modifications which come within the scope of the appended claims is reserved.

We claim:

1. In a device for loading a product into a container wherein the device includes a delivery apparatus movable during a travel cycle toward and away from a travel limit and wherein the product is delivered through the delivery apparatus into the container during a certain portion of the travel cycle, the improvement comprising:

means operable during another portion of the travel cycle prior to the certain portion for applying a coating to an inner wall of the container.

2. The improvement of claim 1, wherein the applying means comprises a sprayer.

3. The improvement of claim 2, wherein the applying means includes means for actuating the sprayer while the delivery apparatus is moving toward the travel limit.

4. In a device for loading a product into a container wherein the device includes a delivery apparatus movable during a travel cycle toward and away from a travel limit and wherein the product is delivered through the delivery apparatus into the container during a certain portion of the travel cycle, the improvement comprising:

means operable during another portion of the travel cycle prior to the certain portion for applying a coating to an inner wall of the container, wherein the applying means comprises a sprayer and means for actuating the sprayer while the delivery apparatus is moving toward the travel limit, and wherein the product comprises restructured meat, the delivery apparatus comprises a stuffing horn, the coating comprises a rub and the container comprises a heat-sealable bag sealed by a heated seal bar after loading of the restructured meat into the bag.

5. In a device for loading a product into a container wherein the device includes a delivery apparatus movable during a travel cycle toward and away from a travel limit and wherein the product is delivered through the delivery apparatus into the container during a certain portion of the travel cycle, the improvement comprising:

means operable during another portion of the travel cycle prior to the certain portion for applying a coating to an inner wall of the container, wherein the container comprises a heat-sealable bag adapted to be sealed by a heated seal bar in a certain portion of the bag after the product is loaded therein and wherein the applying means includes means for creating a coating pattern only on portions of the bag other than the certain portion.

6. The improvement of claim 5, wherein the applying means comprises a pair of sprayers carried with the delivery apparatus and each operable as the delivery apparatus is moving toward the travel limit to spray coating inside the bag.

7. The improvement of claim 6, wherein the creating means comprises a pair of spray tips each carried by one of the sprayers.

8. The improvement of claim 7, wherein the seal bar has an inverted U-shape and wherein the applying means further includes a pair of shields each carried by a sprayer wherein the spray tips and the shields direct coating onto the inner wall of the bag such that an upper coating margin is formed complementary to the inverted U-shape.

9. The improvement of claim 8, wherein the product comprises restructured meat, the delivery apparatus comprises a stuffing horn and the coating comprises a rub.

10. An apparatus for packaging a restructured meat product in a heat-sealable, cook-in bag, comprising:

a stuffing horn movable toward and away from a travel limit;

first and second sprayers disposed on opposite sides of the stuffing horn and moveable therewith;

means for positioning the bag below the stuffing horn and the sprayers;

means for moving the stuffing horn and the sprayers into the bag toward the travel limit;

means for operating the sprayers as the stuffing horn and the sprayers are moving toward the travel limit such that a rub is applied to an inner wall of the bag;

means for reversing the direction of movement of the stuffing horn and the sprayers once the travel limit is reached;

means for operating the stuffing horn such that restructured meat product is deposited into the bag after the travel limit is reached; and means for sealing the bag by applying heat thereto.

11. The apparatus of claim 10, wherein each sprayer includes a spray tip having a base terminating in an upper base surface and a sloped portion disposed at an angle with respect to the upper base surface wherein the upper base surface and the sloped portion direct rub onto the inner wall of the bag.

12. The apparatus of claim 11, wherein the sealing means includes a seal bar that applies heat to a certain portion of the bag and wherein each sprayer further includes a shield mounted thereon and disposed in alignment with the sloped portion wherein the upper base surfaces of the spray tip bases, the sloped portions and the shields substantially prevent rub from being applied to the certain portion of the bag.

13. The apparatus of claim 12, wherein the seal bar has an inverted U-shape and wherein the sloped portion assists in directing rub in a spray pattern having an upper U-shaped margin on the inner wall of the bag.

14. A method of loading a product into a container, the method comprising the steps of:

positioning the container in alignment with a delivery apparatus and a spray apparatus wherein the delivery apparatus and the spray apparatus are movable toward and away from a travel limit;

moving the delivery apparatus and the spray apparatus into the container toward the travel limit;

operating the spray apparatus to deposit a coating on an inner wall of the container as the spray apparatus is moving toward the travel limit;

reversing the direction of movement of the delivery apparatus at the travel limit; and operating the delivery apparatus after operation of the spray apparatus to deliver product into the container.

15. A method of loading a product into a container, the method comprising the steps of:

positioning the container in alignment with a delivery apparatus and a spray apparatus wherein the delivery apparatus and the spray apparatus are movable toward and away from a travel limit;

moving the delivery apparatus and the spray apparatus into the container toward the travel limit;

operating the spray apparatus to deposit a coating on an inner wall of the container as the spray apparatus is moving toward the travel limit;

reversing the direction of movement of the delivery apparatus at the travel limit; and operating the delivery apparatus after operation of the spray apparatus to deliver product into the container, wherein the container comprises a heat-sealable bag adapted to be sealed by a seal bar in a certain portion of the bag after the product is loaded therein and wherein the step of operating the spray apparatus includes the step of creating a coating pattern only on portions of the bag other than the certain portion.

16. The method of claim 15, wherein the spray apparatus includes first and second sprayers fixed on opposite sides of the delivery apparatus and wherein the step of moving comprises the step of causing the sprayers and the delivery apparatus to be moved together toward the travel limit.

17. A method of packaging a restructured meat product, the method comprising the steps of:

providing a heat-sealable bag;

positioning the bag in alignment with a stuffing horn and a spray apparatus wherein the stuffing horn and the spray apparatus are movable toward and away from a travel limit;

moving the stuffing horn and the spray apparatus together into the bag toward the travel limit;

operating the spray apparatus to deposit a rub on an inner wall of the bag as the spray apparatus is moving toward the travel limit;

withdrawing the stuffing horn and the spray apparatus from the bag after the travel limit is reached;

operating the stuffing horn after operation of the spray apparatus to deliver restructured meat product into the bag; and heat sealing the bag after the product is delivered therein.

18. The method of claim 17, including the further step of cooking the restructured meat product after the bag is heat sealed.

19. A device for loading a product into a container comprising;

a delivery apparatus movable to a travel limit wherein the product is delivered through the delivery apparatus into the container after the delivery apparatus reaches the travel limit; and, means operable before the delivery apparatus reaches the travel limit for applying a coating to an inner wall of the container.

20. The device of claim 19 wherein said delivery apparatus is movable toward and away from said travel limit during a travel cycle, and said product is delivered into said container and said coating is applied to said inner wall of the container during said travel cycle.

21. The device of claim 19 wherein said device for applying a coating to said container inner wall is carried with the delivery apparatus.

22. The device of claim 21 wherein the applying means comprises spraying apparatus operable as the delivery apparatus is moving toward said travel limit to spray said coating onto said container inner wall.

* * * * *